US006889611B2

(12) United States Patent
Scherer et al.

(10) Patent No.: US 6,889,611 B2
(45) Date of Patent: May 10, 2005

(54) SMOKE SHELL

(75) Inventors: Werner Scherer, Schweich (DE); Josef Schneider, Kirchheim (DE); Gerald Rieger, Nürnberg (DE)

(73) Assignee: Diehl Munitionssysteme GmbH & Co. KG, Röthenbach (DE)

( * ) Notice: Subject to any disclaimer, the term of this patent is extended or adjusted under 35 U.S.C. 154(b) by 0 days.

(21) Appl. No.: 10/692,899

(22) Filed: Oct. 24, 2003

(65) Prior Publication Data

US 2004/0134372 A1 Jul. 15, 2004

(30) Foreign Application Priority Data

Oct. 26, 2002 (DE) ..... 102 49 920

(51) Int. Cl.[7] ..... F42B 12/48

(52) U.S. Cl. ..... 102/334; 102/342; 102/345; 102/357; 102/499

(58) Field of Search ..... 102/334, 342, 102/345, 351, 352, 357, 360, 499

(56) References Cited

U.S. PATENT DOCUMENTS 2,502,442 A * 4/1950 Driskell ..... 102/334
3,431,852 A * 3/1969 Fowler ..... 102/334
4,446,794 A * 5/1984 Simmons ..... 102/334
5,983,801 A * 11/1999 Brunn ..... 102/334

* cited by examiner

*Primary Examiner*—Harvey E. Behrend
(74) *Attorney, Agent, or Firm*—Scully, Scott, Murphy & Presser

(57) ABSTRACT

A smoke shell (10) which includes a shell casing (12), an ogive (14) fixed to the shell casing (12) and a base (22) releasably connected to the shell casing (12). The ogive (14) has a time fuse (18) operatively connected to an ejection charge (20). A number of smoke pots (26) are provided in the shell casing (12) adjoining each other and the base (22) and an ejection plate (28). An ignitor charge (30) is mounted to the ejection plate (28) in the proximity of the ejection charge (20).

11 Claims, 2 Drawing Sheets

SMOKE SHELL

BACKGROUND OF THE INVENTION

Figure 1:
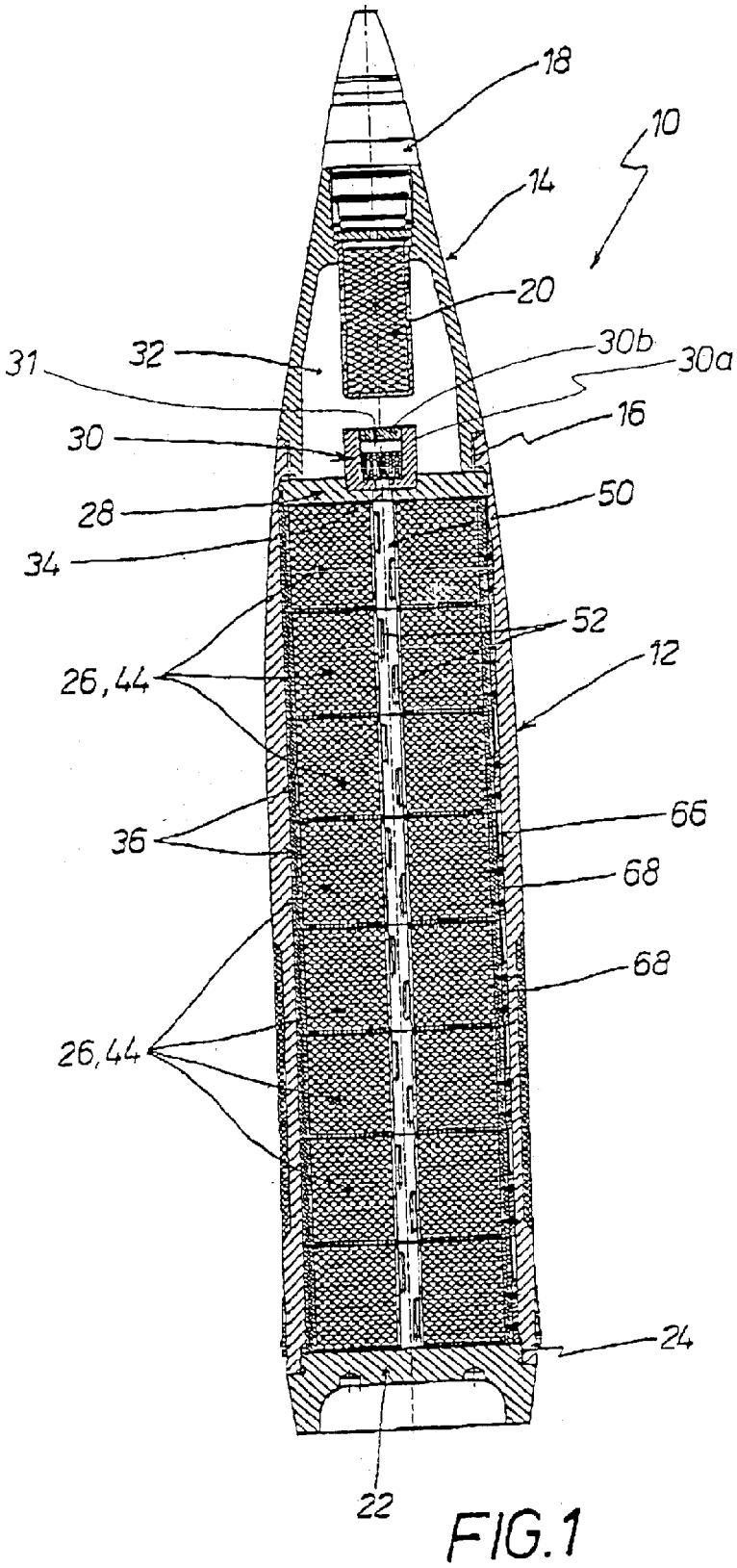

The invention concerns a smoke shell possessing a shell casing with an ogive fixed to the shell casing, and a base releasably fixed to the shell casing. Furthermore, the ogive has a time fuse operatively connected to an ejection charge.

The object of the present invention is to provide a smoke shell of the kind set forth in the opening part of this specification, which can be fired unlimitedly with the highest level of loading, which has self-supporting identical smoke pots and which is intended for the production of a multispectrally covering smoke.

SUMMARY OF THE INVENTION

In accordance with the invention that object is attained in that a number of smoke pots are provided in the shell casing adjoining each other and the base and an ejection plate, wherein an igniter charge is mounted to the ejection plate in the proximity of the ejection charge.

In the smoke shell or projectile according to the invention the shell casing, the ogive which is fixed to the shell casing, and the base which is releasably connected to the shell casing, as well as the ejection charge and the time fuse co-operating with the ejection charge are identical to the corresponding components of a bomblet shell. The smoke shell according to the invention therefore involves a correspondingly reworked bomblet shell. The reworking involved concerns the igniter charge provided at an ejection plate and the smoke pots which are of an identical configuration and structure so that they can be interchanged with each other. This means that assembly errors due to confusion are eliminated.

In the case of the smoke shell according to the invention the igniter charge provided at the ejection plate which virtually forms a piston is matched in respect of its quantitative proportioning and its burning volume to the smoke pots and to the central firing tubes with their firing openings, which tubes extend through the respective smoke pot, thereby to ensure reliable ignition of all smoke pots of the smoke shell. The igniter charge has a housing with a cover. The cover is provided displaceably and has at least one through hole. This provides on the one hand that the pressure chamber for the igniter charge is adjustable and on the other hand it guarantees throttling of the igniter gases of the ejection charge.

The smoke pots are adapted to be self-supporting so that the smoke composition of the smoke shell according to the invention does not have to perform a supporting function upon launch. The wall of the smoke pot which is adjacent to the base of the smoke shell is suitable for carrying the mass of the smoke pots disposed thereabove, and the ejection plate.

In the smoke shell according to the invention the ejection plate is preferably provided in the transitional region between the shell casing and the ogive.

Each smoke pot preferably comprises a pot-shaped housing in which an associated smoke composition is provided, and a cover. Extending through the respective smoke pot is a central firing tube which has firing openings. The cover has a number of openings which are preferably uniformly distributed in the peripheral direction. The smoke issues from those openings after ejection of the smoke pots from the shell. The respective smoke pot can comprise steel so that no fragments are produced.

The central firing tube of the respective smoke pot of the smoke shell according to the invention is desirably fixed between a central hole in the bottom of the pot-shaped housing and a central hole in the cover. The central firing tube can perform a mechanical supporting function upon launch and in regard to the ejection loading.

It is preferable if the respective smoke composition is spaced from the pot-shaped housing and the cover by a damping device in order to ensure unlimited firability of the smoke shell according to the invention, with very high levels of loading, that is to say, in order to afford a bore-safe smoke composition.

In order to guarantee safe ignition of the respective smoke composition, the respective smoke composition is preferably definedly spaced from the associated central firing tube.

It has proven to be advantageous if the respective smoke composition has a number of smoke segments which are distributed in the peripheral direction and which are spaced from each other by damping elements of the damping device. It is advisable for the same purpose if the smoke segments are arranged spaced axially from each other in at least two layers, wherein apertured damping elements of the damping device are provided between adjacent smoke segment layers. Such a design configuration affords unlimited firability of the smoke shell according to the invention with a very high level of load-bearing capability, optimum bore-safety for the smoke pots and reliable ignition of all firing pots after launch of the smoke shell.

It is preferred if the smoke pots are arranged non-rotatably in the shell casing. For that purpose the shell casing can be formed on its inside with a longitudinal groove and a fitting key can project from each smoke casing and can extend into the longitudinal groove. That configuration affords spin-secured smoke pots of an identical configuration.

BRIEF DESCRIPTION OF THE ACCOMPANYING DRAWINGS

Figure 2:
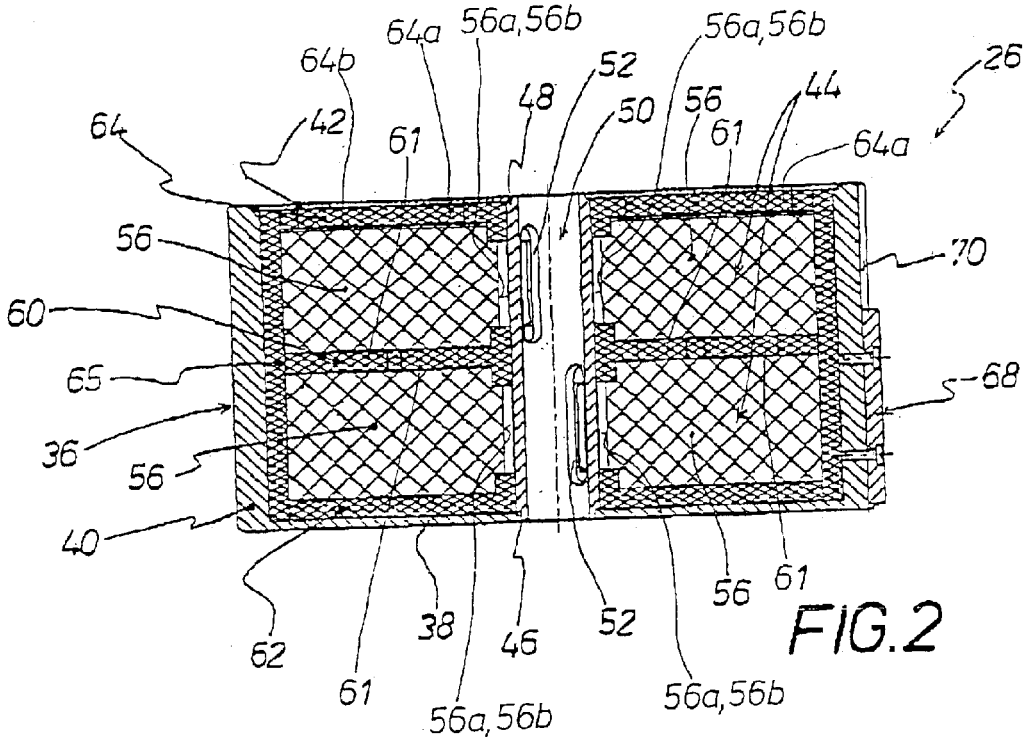
Figure 3:
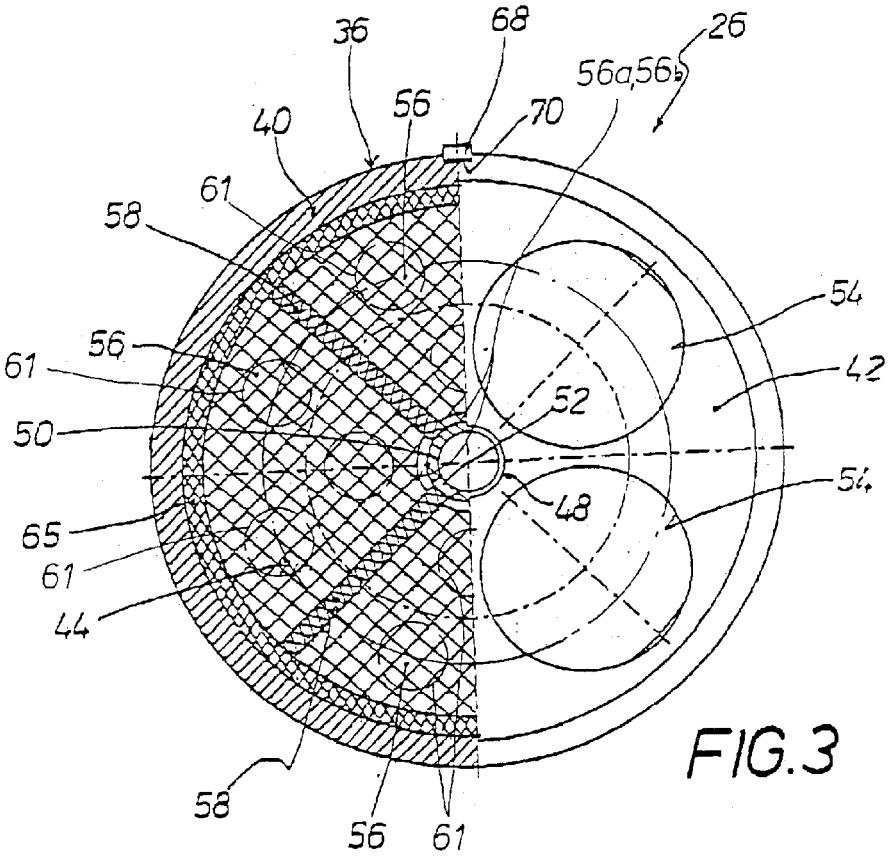

Further details, features and advantages will be apparent from the description hereinafter of an embodiment of the smoke shell according to the invention, illustrated in the drawing in which:

FIG. 1 is a view in longitudinal section of an embodiment of the smoke shell, FIG. 2 is a view in longitudinal section and on a larger scale of a smoke pot of the smoke shell as shown in FIG. 1, and FIG. 3 shows a view of the smoke pot of FIG. 2, half of which is in cross-section and half of which is a plan view.

DETAILED DESCRIPTION OF A PREFERRED EMBODIMENT

FIG. 1 is a view in longitudinal section showing a configuration of the smoke shell or projectile 10 which involves a reworked bomblet projectile. The smoke shell 10 has a shell casing 12, on which an ogive 14 is fixed at the front end. The ogive 14 is fixed to the shell casing 12 by a screw connection 16. The ogive 14 has a time fuse 18 which co-operates with an ejection charge 20 in known manner.

A base 22 is releasably fixed to the shell casing 12 at the rearward end thereof. This fixing involves a shearing connection 24.

Arranged in the shell casing 12 are a number of smoke pots 26 (see in particular also FIGS. 2 and 3) which are of an identical configuration and which adjoin each other and the base 22 at the rear end and an ejection plate 28 at the front end. An igniter charge 30 is mounted to the ejection plate 28. The igniter charge 30 has a housing 30*a* and a displaceable cover 30*b*. The cover 30*b* is provided with at least one through hole 31.

The ogive 14 and the ejection plate 28 define in the smoke shell 10 a pressure chamber 32 into which the ejection charge 20 projects and in which the igniter charge 30 is disposed.

The ejection plate 28 is provided with a central through hole 34. Each smoke pot 26 has a pot-shaped housing 36 (see also FIGS. 2 and 3) with a housing bottom 38 and a housing wall 40 which extends away from the housing bottom 38. The pot-shaped housing 36 of each smoke pot 26 is closed by means of a cover 42, for example by crimping or peening over. A smoke composition 44 is arranged in the pot-shaped housing 36.

The housing bottom 38 is provided with a central hole 46 and the cover 42 has a central hole 48. A firing tube 50 is fixed between the central hole 46 in the housing bottom 38 and the central hole 48 in the cover 42. Each firing tube 50 of the smoke pots 26 is provided with firing openings 52.

As can be seen from FIG. 3 the cover 42 of each smoke pot 26 has a number of openings 54 which are arranged uniformly distributed in the peripheral direction.

The smoke composition 44 of the respective smoke pot 26 has a number of smoke segments 56 which—as can be seen from FIG. 3—are distributed uniformly in the peripheral direction. Each smoke segment 56, at its inside surface 56*a* which is towards the central firing hole 50, is provided with an NC—Al-coating 56*b*.

FIG. 2 clearly shows that the smoke segments 56 are arranged spaced axially from each other in two layers. The smoke segments 56 of each layer are spaced from each other by radially oriented damping elements 58 (see FIG. 3). Provided between the adjacent layers of the smoke segments 56 is a damping element 60 (see FIG. 2) which is formed with holes 61 (see FIG. 3).

Provided between the smoke segments 56 which are adjacent to the housing bottom 38 and the housing bottom 38 is a damping element 62 and provided between the smoke segments 56 which are adjacent to the cover 42 and the cover 42 is a damping element 64. The damping element 64—similarly to the damping element 60—has holes 64*a*. The holes 64*a* are provided in a manner corresponding to the openings 54 of the cover 42. Provided between the layer of smoke segments 56, which is adjacent to the cover 42, and the apertured damping element 64, there is at least one film element 64*a* which serves for dimensional tolerance equalisation.

The smoke segments 56 are spaced from the wall 40 of the housing of the respective smoke pot 26 by a damping element 65. The damping elements 60, 62, 64 and 65 form a damping device by which the respective smoke composition 44 is definedly spaced from the associated firing tube 50 in order to guarantee reliable ignition of the smoke composition 44 after launch of the smoke shell 10. Play-free installation of the smoke segments 56 in the associated smoke pot 26 is afforded by means of the damping device and the dimensional tolerance equalisation effect produced by the at least one film element 64*a*.

As can be seen from FIG. 1 the shell casing 12 is provided on its inside with a longitudinal groove 66. A fitting key 68 projects from each smoke pot 26, that is to say from the wall 40 of the pot-shaped housing 36 of the respective smoke pot 26. The respective fitting key 68 is screwed fast to the housing wall 40 (see FIG. 2). The fitting key 68 is fitted into a groove 70 provided in the housing wall 40. The fitting key 68 projects with a sliding fit into the longitudinal groove 66 in the shell casing 12. The axial length of the fitting key 68 corresponds to somewhat more than half the structural height of the respective smoke pot 26. That affords a sufficiently large force-transmission surface area between the respective smoke pot 26 and the shell casing 12 of the smoke shell so that the spin of the smoke shell 10 is transmitted to the smoke pots 26 without any problem. The longitudinal groove 66 in the shell casing 12 ends slightly in front of the fitting key 68 of the smoke pot 26 which is adjacent to the ejection plate 28, as FIG. 1 clearly shows.

The igniter charge 30 and the smoke pots 26 with the smoke compositions 44 and the central firing tubes 50 form an optimised matched overall system.

The mode of operation of the smoke shell 10 is as follows:

After launch and after expiry of the preset time at the time fuse 18 the ejection charge 20 is fired. When the ejection charge 20 burns away gas is produced and at the same time the igniter charge 30 provided at the ejection plate 28 is fired. The gas pressure generated by the ejection charge 20 applies a corresponding pressure to the ejection plate 28 so that, by way of the smoke pots 26, the shearing connection 24 between the shell casing 12 and the base 22 of the smoke shell 10 is released and the base 22 is separated from the smoke shell 10. At the same time the smoke compositions 44 are ignited by the igniter charge 30 burning away, through the central and mutually axially aligned firing tubes 50. While the smoke compositions 44 start to burn the procedure involving ejection of the smoke pots 26 from the shell casing 12 begins. The smoke pots 26 are ejected from the smoke shell 10 and fall to the ground for example from a height of about 300 m. The spin of the smoke shell 10 and the discharge disturbances of the smoke pots 26 cause a natural scatter thereof and thus produce corresponding distribution of the smoke pots 26 at the ground. The smoke pots 26 which are on the ground then produce a multispectrally covering smokescreen.

LIST OF REFERENCES

10 smoke shell
12 shell casing (of 10)
14 ogive (of 10)
16 screw connection (between 12 and 14)
18 time fuse (at 14 for 20)
20 ejection charge
22 base (of 10)
24 shearing connection (between 22 and 12)
26 smoke pots (in 10)
28 ejection plate (for 26)
30 igniter charge (at 28)
30*a* housing (of 30)
30*b* cover (for 30*a*)
31 hole (in 30*b*)
32 pressure chamber (in 14)
34 central through hole (in 28)
36 pot-shaped housing (of 26)
38 housing bottom (of 36)
40 housing wall (of 36)
42 cover (of 26)
44 smoke composition (in 26)
46 central hole (in 38)

48 central hole (in 42)

50 firing tube (between 46 and 48)

52 firing openings (in 50)

54 openings (in 42)

56 smoke segments (of 44)

56*a* internal surface (of 56)

56*b* NC—Al-coating (on 56*a*)

58 damping elements (between 56)

60 damping elements (between 56)

61 holes (in 60)

62 damping element (between 38 and 56)

64 damping element (between 56 and 42)

64*a* holes (in 64)

64*b* film element (between 56 and 64)

65 damping element (between 40 and 56)

66 longitudinal groove (in 12)

68 fitting key (on 40)

70 groove (for 68 in 40)

What is claimed is:

1. A smoke shell comprising a shell casing (12), an ogive (14) fixed to the shell casing (12) and a base (22) releasably connected to the shell casing (12), wherein the ogive (14) has a time fuse (18) operatively connected to an ejection charge (20), characterized in that a number of smoke pots (26) are provided in the shell casing (12) adjoining each other and the base (22) and an ejection plate (28), said ejection plate being positioned in said casing between said ogive and said smoke pots, wherein an igniter charge (30) is mount to the ejection plate (28) in the proximity of the ejection charge (20).

2. A smoke shell according to claim 1 characterised in that the ejection plate (28) is provided in the transitional region between the shell casing (12) and the ogive (14).

3. A smoke shell according to claim 1 characterised in that each smoke pot (26) has a pot-shaped housing (36) with a cover (42), wherein a smoke composition (44) is provided in the respective smoke pot (26) and wherein a central firing tube (50) which is formed with firing openings (52) extends through the respective smoke pot (26).

4. A smoke shell according to claim 3 characterised in that the cover (42) is provided with a number of openings (54) which are distributed uniformly in the peripheral direction.

5. A smoke shell according to claim 3 characterized in that the central firing tube (50) is fixed between a central hole (46) in the bottom (38) of the pot-shaped housing (36) and a central hole (48) in the cover (42).

6. A smoke shell according to claim 3 characterised in that the respective smoke composition (44) is spaced from the pot-shaped housing (36) and the cover (42) by a damping device.

7. A smoke shell according to claim 5 or 6 characterised in that the respective smoke composition (44) is definedly spaced from the central firing tube (50).

8. A smoke shell according to claim 6 characterised in that the respective smoke composition (44) has a number of smoke segments (56) which are distributed in the peripheral direction and which are spaced from each other by damping elements (58) of the damping device.

9. A smoke shell according to claim 8 characterised in that the smoke segments (56) are arranged spaced axially from each other in at least two layers, wherein damping elements (60) of the damping device are provided between adjacent smoke segment layers.

10. A smoke shell according to claim 1 characterised in that the smoke pots (26) are arranged non-rotatably in the shell casing (12).

11. A smoke shell according to claim 10 characterised in that the shell casing (12) is provided at the inside with a longitudinal groove (66) and that a fitting key (68) projects from each smoke pot (26) and extends into the longitudinal groove (66).

* * * * *